United States Patent [19]

Linder et al.

[11] Patent Number: 4,994,705

[45] Date of Patent: Feb. 19, 1991

[54] WATER-COOLED, LOW PRESSURE GAS DISCHARGE LAMP

[75] Inventors: Jacques F. Linder, Palos Verdes; Steven H. Boland, Glendora, both of Calif.

[73] Assignee: Hughes Aircraft Company, Los Angeles, Calif.

[21] Appl. No.: 329,050

[22] Filed: Mar. 27, 1989

[51] Int. Cl.[5] ..... H01J 61/30; H01J 61/52

[52] U.S. Cl. ..... 313/24; 313/36; 313/12; 313/634

[58] Field of Search ..... 313/24, 22, 36, 634, 313/12; 362/230, 264

[56] References Cited

U.S. PATENT DOCUMENTS

| | | | |
|---|---|---|---|
| 1,925,155 | 9/1933 | Sanders | 313/22 X |
| 1,963,962 | 6/1934 | Barclay | 313/610 X |
| 2,096,357 | 10/1937 | Francis et al. | 313/22 |
| 2,339,906 | 1/1944 | Barnes | 313/22 X |
| 2,473,642 | 6/1949 | Found et al. | 313/572 X |
| 2,743,388 | 4/1956 | Bartley | 313/634 X |

FOREIGN PATENT DOCUMENTS

| | | | |
|---|---|---|---|
| 1131028 | 6/1962 | Fed. Rep. of Germany | 313/12 |
| 1052513 | 12/1966 | United Kingdom | 313/22 |
| 1514281 | 6/1978 | United Kingdom | 313/634 |

OTHER PUBLICATIONS

"Electric Discharge Lamps", by H. Cotton, Publisher: Chapman & Hall Ltd., 1946, pp. 313-314.

"Fluorescent Lamps and Lighting", by Elan-Baas et al., Publishers: Philips Technical Library, 1962, pp. 93-96.

*Primary Examiner*—Palmer C. DeMeo

*Attorney, Agent, or Firm*—M. E. Lachman; W. K. Denson-Low

[57] ABSTRACT

A water-cooled low pressure gas or mercury vapor lamp which utilizes a cooling system to keep the lamp cool in the area where useful radiation is emitted. This is accomplished by means of a cooling chamber directly adjacent to the gas or mercury vapor discharge chamber. A cooling fluid is injected into the cooling chamber through a cooling inlet and exits the cooling chamber through a cooling outlet after traveling the cooling chamber's entire length. The cooling fluid removes the heat generated by the radiation and allows the useful emission to be optimized.

14 Claims, 2 Drawing Sheets

10
12
14
16
18
19
20
21

52
54
55
60
62

22
24
26
28
30
31
32
34
36
38
III
III

WATER-COOLED, LOW PRESSURE GAS DISCHARGE LAMP

BACKGROUND OF THE INVENTION

1. Field of the Invention

The present invention relates to low pressure gas or mercury vapor discharge lamps and, more particularly, is concerned with apparatus and methods for cooling such low pressure gas or mercury vapor lamps.

2. Description of Related Art

Photochemical vapor deposition (photo-CVD) uses radiation to photochemically induce the deposition of thin layers on various substrates. The technique is particularly popular due to the relatively low temperatures at which deposition can be accomplished. Photo-CVD can be used to deposit thin films of selected materials onto various different substrates such as plastics, metals, glass, and composite material. This process is especially well-suited for treating numerous substrates, such as plastics, which cannot tolerate the high temperatures generally required with more conventional thermal vapor deposition techniques.

Ultraviolet (UV) radiation in the 180 nanometers (nm) to 260 nm wavelength region is commonly used in many photo-CVD processes to induce the photochemical reactions. This UV radiation is typically provided by low pressure mercury vapor lamps because they are often the cheapest and most convenient light source available which is capable of providing radiation in the required wavelength range.

Mercury vapor has emission lines at 185 nm and 254 nm. These lines carry a large percentage of the light energy emitted by an electric arc in the mercury vapor, so long as the temperature is kept below about 60° C. to 70° C. At higher temperatures, there is a shift in vapor emission to longer, less energetic wavelengths. These lower energy emissions are not suitable for many photo-CVD reactions. Accordingly, it is important that the temperature of the mercury vapor lamp be kept below 70° C.

The cooling of low pressure mercury lamps has presented a number of problems because of substantial amount of heat is generated even during low power density operations. This problem is magnified greatly due to the added heat generated when the power density is increased to levels required for many photo-CVD processes.

A conventional low pressure mercury vapor lamp is shown at 10 in FIG. 1. The lamp 10 includes a circular tube 12 which is usually made from quartz. The tube 12 is filled with enough mercury vapor to create a maximum pressure of between about 20 to 500 millibars. Electrodes 14 and 16 provide the electric current or arc through the vapor to produce the desired UV discharge. A divider 18 is generally placed within the tube to increase the arc length without increasing the overall tube length.

Several different cooling systems have been used to cool lamps such as the one shown in FIG. 1. For example, forced air cooling is often used and provides sufficient cooling for low power density operations. Unfortunately, forced air cooling is generally not sufficient to cool mercury vapor lamps operated at high power densities. Water cooling or some other form of liquid cooling is usually required to keep high power lamps sufficiently cool. Water jackets which completely surround the lamp tube provide adequate cooling. However, water absorbs the high energy wavelengths which are necessary for photo-CVD progresses.

Attempts have been made to provide a liquid cooling jacket surrounding the electrode chamber, for example, in the manner shown at 20 in FIG. 1, with water entering the jacket at 19 and exiting at 21. However, the water jacket does not provide adequate cooling of the mercury vapor at the opposite end of the lamp. Furthermore, the use of a water jacket 20 around the base of the lamp 10 makes the bulkiest part of the lamp even bulkier.

As is apparent from the above, a need presently exists for improving the cooling systems of low pressure mercury vapor or gas discharge lamps to provide optimum cooling without adversely affecting the lamps' ability to generate high energy UV light or other radiation.

SUMMARY OF THE INVENTION

In accordance with the present invention, a low pressure gas or mercury vapor lamp is disclosed which has an efficient and simple liquid cooling system which allows the lamp to produce maximum radiation emission at high energy densities.

The present invention is based on a fluid cooled low pressure gas or mercury vapor lamp which includes a lamp tube having a wall located inside the lamp tube which extends the entire length of the lamp tube and divides the lamp tube into a discharge chamber and a cooling chamber. Cooling inlets and outlets are provided so that cooling fluid can be passed through the cooling chamber to remove the heat generated in the discharge chamber during the operation of the low pressure gas or mercury lamp. Electrodes are provided for creating an arc through the mercury vapor.

The central wall which separates the cooling chamber from the discharge chamber provides a large surface area for efficient transfer of heat. The present invention utilizes a cooling system to keep the lamp tube and its gas contents cool in the very portion of the lamp where the useful radiation is emitted. The invention, however, does not create a curtain of water which could prevent UV radiation from reaching the substrate. Instead it provides high energy radiation over a 180° area. This allows the lamp to operate at power densities which emit at least three times the UV energy density of the known air cooled lamps. This allows the photo-CVD deposition rate observed with the present invention to be at least three times the rate presently observed with the air cooled lamps.

A wide variety of the shapes can be utilized with the present invention because the cooling system is readily adaptable to any shaped tube. Therefore, regardless of whether the lamp tube is straight or convoluted, the cooling chamber will provide a maximum cooling effect. In addition, when 360° radiation is needed, multiple lamp embodiments can provide 360° radiation either inward or outward.

The above-discussed and many other features and attendant advantages of the present invention will become apparent as the invention becomes better understood by reference to the following detailed description when considered in conjunction with the accompanying drawings.

DESCRIPTION OF THE PREFERRED EMBODIMENTS

Figures 1, 2, 3, 7:
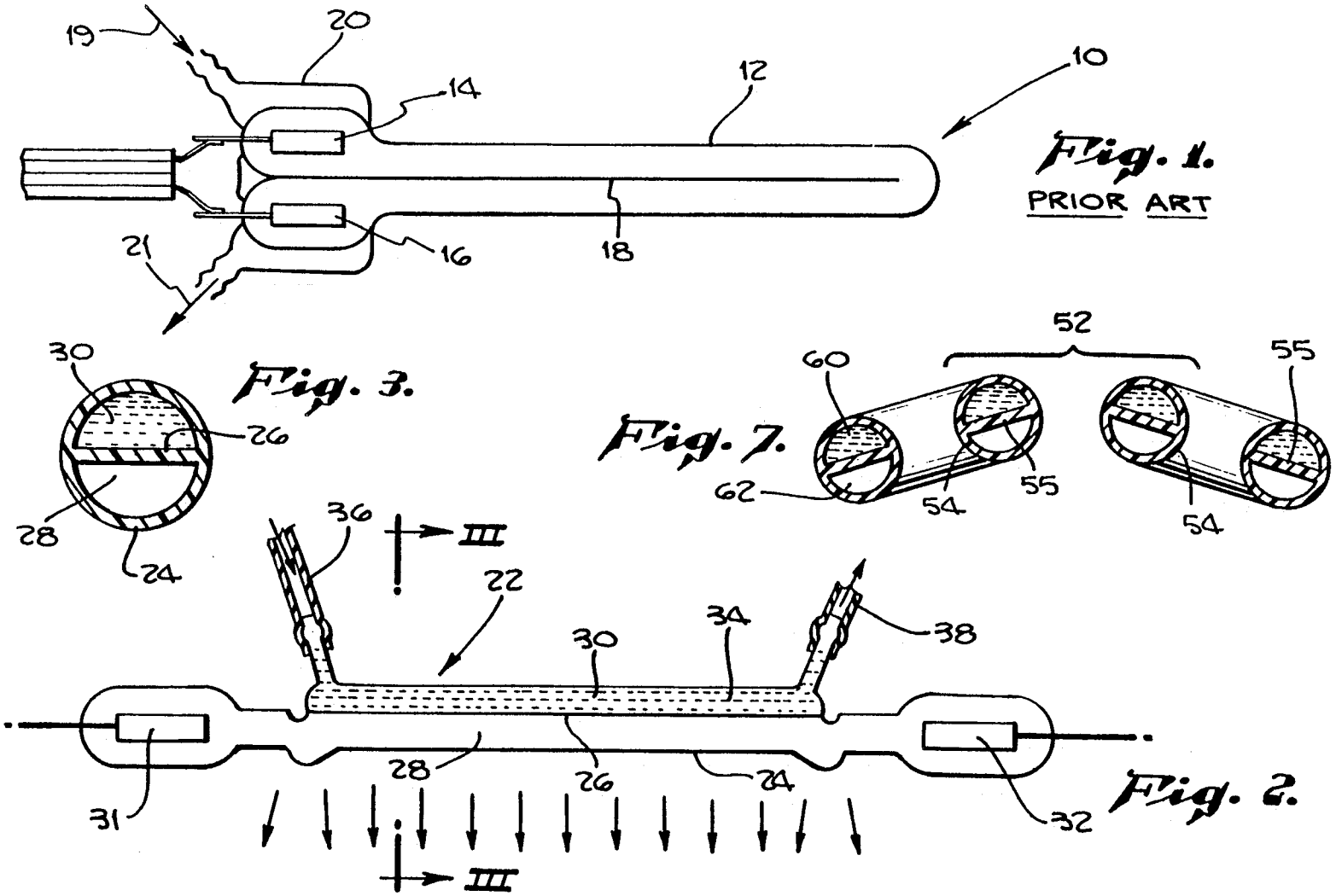
Fig. 1. PRIOR ART
FIG. 1 is a side view of a conventional mercury discharge lamp.
FIG. 2 is a side view of the first preferred exemplary water-cooled, low pressure gas or mercury lamp of the present invention.
FIG. 3 is an end sectional view of the first preferred exemplary water-cooled, low pressure gas or mercury lamp of the present invention taken in the III—III plane of FIG. 2.
FIG. 7 is a bottom sectional view of one of the lamp elements of the third preferred exemplary water-cooled, low pressure gas or mercury lamp of the present invention taken in the VII—VII plane of FIG. 5.

A first preferred exemplary embodiment of a gas or mercury vapor lamp in accordance with the present invention is shown at 22 in FIG. 2. For ease of explanation, the following description is directed to a mercury vapor lamp. However, it is not intended to limit the present invention to a mercury vapor lamp, but rather to include any gas lamp in which an electric current or arc is passed through the gas to produce radiation of a specified wavelength. The gas or mercury vapor lamp 22 includes a lamp tube 24 which is preferably straight. The outside perimeter of the lamp tube 24 is preferably round, but may be any configuration including square, rectangular or triangular. As shown in FIGS. 2 and 3, a wall 26 divides the tube 24 into a mercury vapor discharge chamber 28 and a separate cooling chamber 30. Although this wall 26 is preferably located in the center of the lamp tube 24 as shown in FIG. 3, it can also be positioned off-center such that the mercury vapor discharge chamber 28 and the cooling chamber 30 are not of equal size. In addition, the lamp tube 24 is preferably made of quartz, but may also be formed from other material which is suitable for use in a low pressure mercury vapor lamp, such as a UV-transparent glass. Optionally, the lamp tube 24 is made of a material which is compatible with other gases besides mercury vapor, which may be used in a discharge lamp.

In the preferred embodiment, the wall 26 is preferably made of quartz or out of the same material as the lamp tube 24 so long as the material comprising the wall 26 is heat conductive and electrically insulating. The wall 24 may be made from other heat conductive, electrically insulating materials such as a vacuum-tight ceramic compatible with the tube material. The wall 26 may be impregnated with heat conductive particles, if desired, to increase heat transfer from the discharge chamber 28 to the cooling chamber 30. Any suitable materials may be used so long as they are compatible with the lamp tube materials and mercury vapor or other gas used.

Electrodes, shown in FIG. 2 at 31 and 32, are conventional electrodes which are provided as the means for creating an electric arc through the mercury vapor or other gas by which the ultraviolet light or other specified radiation is produced. Other means which produce an electric arc including RF inductive, capacitive discharge, or microwave means, may also be used. The type of gas or vapor, as well as its concentration and pressure, used in the discharge chamber 28 is not critical and can be any of the vapors and gases commonly used in gas discharge lamps.

The lamp tube 24 is cooled by a cooling fluid 34 which enters the cooling chamber 30 through a cooling inlet 36. The cooling fluid 34 travels the entire length of the cooling chamber 30 and exits through a cooling outlet 38. The liquid moving through cooling chamber 30 removes the heat generated during the operation of the lamp 22 such that a higher power application can be achieved, while the temperature is kept at acceptable levels to maximize the radiation output at a specific wavelength or wavelength range.

The preferred cooling fluid is water, however, other conventional cooling fluids can also be used, such as oils, freon or other known liquids or gases conventionally used for heat exchange and cooling purposes.

Figure 4:
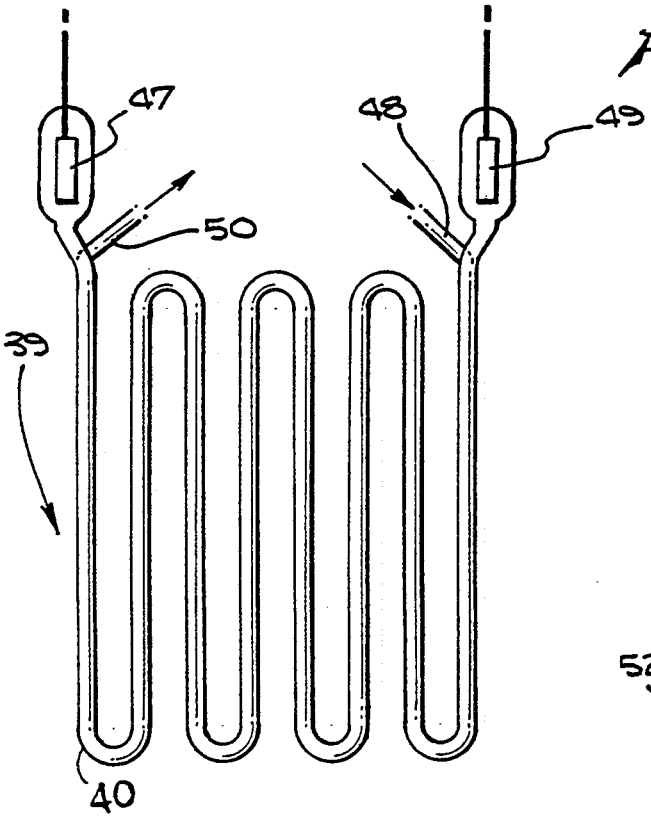
FIG. 4 is a side view of the second preferred exemplary water-cooled, low pressure gas or mercury lamp of the present invention.

A second preferred exemplary embodiment of the apparatus is shown in FIG. 4 at 39. The lamp tube 40 is serpentine-shaped to increase the space occupied by the lamp. The lamp tube 40 is divided into separate cooling and discharge chambers in the same manner as the lamp tube 24 shown in FIGS. 2 and 3. Cooling fluid inlet 48 is provided for introducing the cooling fluid into the cooling chamber side of lamp tube 40. The cooling fluid travels the entire length of tube 40 and is removed through outlet 50. This provides an especially efficient heat removal mechanism because the cooling fluid provides heat exchange and removal over the entire length of the serpentine-shaped tube 40. As a result, uniform heat removal is accomplished and localized overheating of discrete portions of the lamp tube 24 is avoided. Conventional electrodes 47 and 49 are provided to create the electric arc through the mercury vapor or other gas in the discharge chamber, as is well known.

Figure 5:
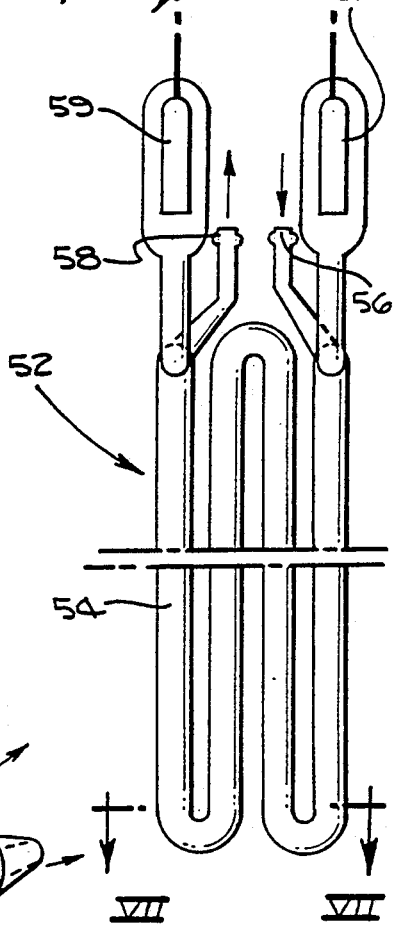
FIG. 5 is a side view of one of the lamp elements of a third preferred exemplary water-cooled, low pressure gas or mercury lamp of the present invention.
Figure 6:
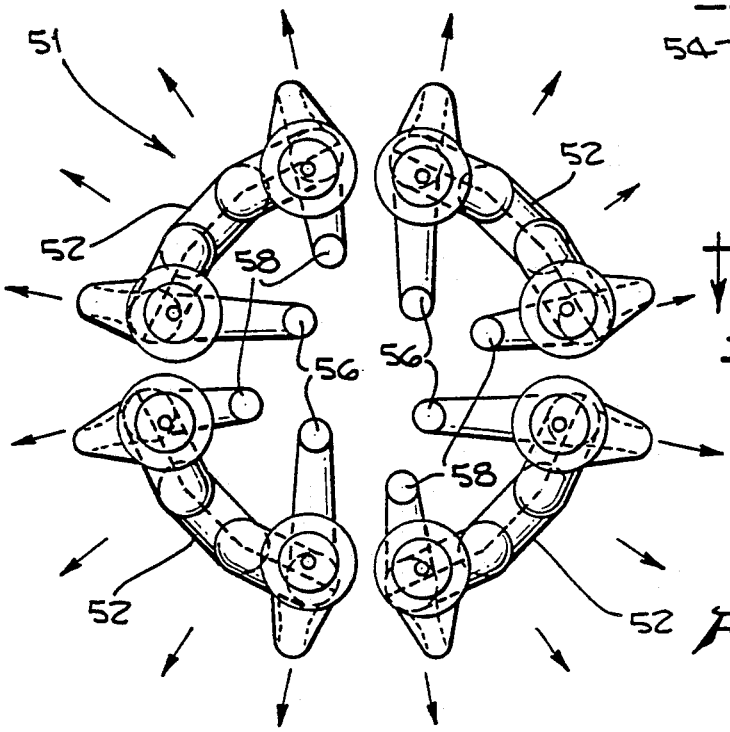
FIG. 6 is a top view of the third preferred exemplary water-cooled, low pressure gas or mercury lamp of the present invention.

A third preferred exemplary embodiment of the present invention is shown generally at 51 in FIG. 6. The lamp 51 is made up of four separate lamp elements 52. Side and cross-sectional views of an individual lamp element 52 are shown in FIGS. 5 and 7 respectively.

Each lamp element 52 includes a lamp tube 54. Central wall 55 is provided in the same manner as the prior embodiments to separate the lamp tube 54 into a cooling chamber 60 and discharge chamber 62.

Cooling fluid inlet 56 is provided to introduce cooling fluid into the cooling chamber 60. The cooling fluid travels the entire length of the serpentine-shaped lamp tube 54 and exits through outlet 58. Conventional electrodes 57 and 59 are provided to create the electric arc within discharge chamber 62. It should be pointed out that in all of the embodiments, the electrodes and the chambers housing the electrodes are maintained separate from the cooling system and are only connected to the discharge chambers in which the mercury vapor or gas is located.

As can be seen in FIG. 6, the four individual lamp elements 52 are arranged in a circular pattern wherein the discharge chambers 62 are all located on the outer perimeter of the circular lamp arrangement. This arrangement provides a 360° ultraviolet light emission which is not possible when individual lamps are used alone.

In addition to the embodiment shown in FIG. 6, the individual lamp elements 52 may be configured so that the discharge chambers 62 are all located on the inside of the lamp perimeter. This particular configuration allows uniform inward radiation from all locations around the lamp perimeter. This configuration is well suited for photo-CVD in a tubular reactor and other processes wherein it is desirable to provide high power density radiation of materials at a single location within a defined lamp perimeter. Although a circular lamp arrangement is shown in FIG. 6, other arrangements are possible, such as square arrangements, hexagonal arrangements and other polygonal arrangements. Further, if desired, the orientation of the individual elements 52 may be alternated so that radiation both outward and inward from the lamp perimeter can be provided if desired.

Measurements of the UV intensity obtained with a mercury vapor lamp element in accordance with the present invention, as shown in FIG. 5, were compared with a low-pressure, air-cooled, hairpin-shaped mercury lamp, obtained from Canrad Hanovia Inc. of Newark, N.J., specifically model 688 A 45. Both UV lamps were placed in a horizontal position at 6.5 cm from a UV light photometer. This 6.5 cm is a typical distance between the light source and substrate in a flat photo-CVD chamber. The UV photometer was a model UVX obtained from Ultraviolet Products of San Gabriel, Calif. The UV photometer was tuned for the 2537 angstrom wavelength which is necessary for conventional mercury-sensitized photo-CVD processes.

With the Hanovia lamp which represents the prior art technology, the maximum power density observed at the photometer was 4.84 $mw/cm^2$. With the water-cooled lamp of the present invention, the maximum power density observed was 13.05 $mw/cm^2$. As can be seen, the lamp element of the present invention provided a 2.7-fold increase in the useful UV energy density over that available from the conventional Hanovia lamp. The increased UV energy density provided by the lamp element of the present invention, provides increase energy for the photochemical reaction and increased deposition rates.

Having thus described exemplary embodiments of the present invention, it should be noted by those skilled in the art that the within disclosures are exemplary only and that various other alternatives, adaptations and modifications may be within the scope of the present invention which is defined and limited only by the following claims.

What is claimed is:

1. A liquid-cooled low pressure gas discharge lamp adapted for use in photochemical vapor deposition, said discharge lamp being of the type having a gas discharge chamber for providing radiation at wavelengths of 185 nm and 254 nm, said lamp comprising:

a lamp tube having an outside perimeter and having a centrally located wall extending the length of said lamp tube which divides said lamp tube into a discharge chamber and a separate cooling chamber;

a sufficient amount of gas in said discharge chamber to provide emission of radiation having wavelenghs of 185 nm and 254 nm when a electric arc is passed through said chamber when said chamber is maintained at a temperature of below about 70° C.;

means for providing an electric arc through said discharge chamber;

cooling means for providing a flow of cooling liquid through said cooling chamber to thereby remove sufficient heat generated during operation of said low pressure gas discharge lamp to maintain the temperature of said discharge chamber at a temperature of below about 70° C. and thereby maximize said radiation having wavelengths of 185 nm and 254 nm, wherein said radiation passes from said discharge tube through only the portion of said outside perimeter of said lamp tube which defines said discharge tube.

2. An apparatus according to claim 1, wherein said lamp tube is made of quartz.

3. An apparatus according to claim 2, wherein said lamp tube is round.

4. An apparatus according to claim 3, wherein the length of said lamp tube is straight.

5. An apparatus according to claim 3, wherein said lamp tube is serpentine-shaped.

6. An apparatus according to claim 1, wherein said cooling liquid is selected from the group consisting of water, oil, and freon.

7. A liquid-cooled low pressure gas discharge lamp system comprising a plurality of gas discharge lamps according to claim 1 which are located to provide a lamp perimeter having a polygonal shape.

8. A liquid-cooled low pressure gas discharge lamp system according to claim 7 wherein the discharge chambers of said gas lamps are facing outward from the lamp perimeter.

9. A liquid-cooled low pressure gas discharge lamp system according to claim 7 wherein the discharge chambers of said gas lamps are facing inward from the lamp perimeter.

10. A liquid-cooled low pressure gas discharge lamp system according to claim 7 wherein the discharge chambers of a portion of said gas lamps are facing outward from the lamp perimeter and the discharge chambers of the remainder of said gas lamps are facing inward from the lamp perimeter.

11. A liquid-cooled low pressure discharge lamp system comprising a plurality of gas discharge lamps according to claim 1 which are located to provide a lamp perimeter having a circular shape.

12. A liquid-cooled low pressure gas discharge lamp system according to claim 11 wherein the discharge chambers of said gas lamps are facing outward from the lamp perimeter.

13. A liquid-cooled low pressure gas discharge lamp system according to claim 11 wherein the discharge chambers of said gas lamps are facing inward from the lamp perimeter.

14. A liquid-cooled low pressure gas discharge lamp system according to claim 11 wherein the discharge chambers of a portion of said gas lamps are facing outward from the lamp perimeter and the discharge chambers of the remainder of said gas lamps are facing inward from the lamp perimeter.

* * * * *